US008820587B2

(12) United States Patent
Imai et al.

(10) Patent No.: US 8,820,587 B2
(45) Date of Patent: Sep. 2, 2014

(54) CONNECTOR

(75) Inventors: Takashi Imai, Gyoda (JP); Koichi Abe, Gyoda (JP)

(73) Assignee: Surpass Industry Co., Ltd., Gyoda-Shi, Saitama (JP)

( * ) Notice: Subject to any disclaimer, the term of this patent is extended or adjusted under 35 U.S.C. 154(b) by 0 days.

(21) Appl. No.: 13/599,902

(22) Filed: Aug. 30, 2012

(65) Prior Publication Data

US 2012/0318374 A1 Dec. 20, 2012

Related U.S. Application Data

(63) Continuation of application No. 11/793,427, filed as application No. PCT/JP2005/023341 on Dec. 20, 2005, now abandoned.

(30) Foreign Application Priority Data

Dec. 27, 2004 (JP) ..... 2004-377922

(51) Int. Cl.
*B65D 83/00* (2006.01)
*B67D 1/08* (2006.01)
*B67D 7/02* (2010.01)

(52) U.S. Cl.
CPC ..... *B67D 7/0288* (2013.01); *B67D 1/0829* (2013.01)
USPC ..... 222/394; 222/464.1

(58) Field of Classification Search
CPC ..... B67D 7/0228; B67D 1/0829
USPC ..... 222/400.7, 464.1, 394; 137/212
See application file for complete search history.

(56) References Cited

U.S. PATENT DOCUMENTS

| | | | | |
|---|---|---|---|---|
| 2,096,686 | A | | 10/1937 | Raible |
| 3,065,885 | A | | 11/1962 | Chatten |
| 3,438,553 | A | | 4/1969 | Johnston |
| 3,939,860 | A | | 2/1976 | Golding |
| 4,181,143 | A | * | 1/1980 | Fallon ..... 137/322 |
| 4,351,456 | A | * | 9/1982 | Nezworski ..... 222/400.7 |

(Continued)

FOREIGN PATENT DOCUMENTS

| | | | |
|---|---|---|---|
| JP | 63-232127 | A | 9/1988 |
| JP | 2002-114242 | | 4/2002 |
| JP | 2002-523314 | A | 7/2002 |
| JP | 3098949 | | 10/2003 |

OTHER PUBLICATIONS

European Search Report dated Feb. 11, 2009 for PCT/JP2005/023341.

(Continued)

*Primary Examiner* — Daniel R Shearer
(74) *Attorney, Agent, or Firm* — Thomas, Karceski & Karmilovich, PC

(57) ABSTRACT

A connector is described that is capable of reducing an amount of liquid remaining in a container when the liquid is drawn out therefrom. The connector includes a connecting unit having a threaded portion that is screwed onto a container-side threaded portion; a main body coupled so as to have a common a central axis with the connecting unit, and a siphon tube that is secured to the main body and that extends to a bottom portion of the container. The connecting unit and the main body are connected so as to be capable of relatively rotating about the central axis.

16 Claims, 5 Drawing Sheets

(56) References Cited

U.S. PATENT DOCUMENTS

| | | | | |
|---|---|---|---|---|
| 4,411,287 | A | 10/1983 | Hyde | |
| 5,203,477 | A * | 4/1993 | Lo | 222/153.01 |
| 5,988,456 | A | 11/1999 | Laible | |
| 6,142,345 | A * | 11/2000 | Laible | 222/189.1 |
| 6,286,730 | B1 * | 9/2001 | Amidzich | 222/400.7 |
| 6,568,427 | B2 | 5/2003 | Imai | |
| 2001/0052366 | A1 | 12/2001 | Ozawa | |

OTHER PUBLICATIONS

Office Action for corresponding Japanese Patent Application No. JP 2004-377922, mailed May 10, 2011.

International Search Report dated Feb. 14, 2006 for PCT/JP2005/023341.

* cited by examiner

CONNECTOR

CROSS-REFERENCE TO RELATED APPLICATION(S)

This is a continuation application of U.S. patent application Ser. No. 11/793,427, filed on Jun. 20, 2007, which is the National Stage Entry Application of International Patent Application No. PCT/JP2005/023341, filed on Dec. 20, 2005, which is based upon and claims priority to Japanese Patent Application No. 2004-377922, filed on Dec. 27, 2004, the contents of all of which are incorporated herein by reference.

FIELD OF THE INVENTION

The present invention relates to a connector.

DESCRIPTION OF RELATED ART

Liquid, such as semiconductor high-purity chemicals or ordinary chemical agents, is usually shipped in containers, such as tanks, filled at manufacturing plants, with lids fitted onto at least a pair of openings provided on the container.

When the liquid stored in the container is drawn out therefrom, first, the lids fitted onto the openings of the container are removed, and then, one plug to which a siphon tube is connected and another plug to which the siphon tube is not connected are each attached to the container. Thereafter, a socket to which a liquid transfer hose is connected is connected to the plug to which the siphon tube is connected, and a socket to which a gas supply hose is connected is connected to the plug to which the siphon tube is not connected.

In this state, the liquid in the container is drawn out from the siphon tube to the plug by a pump and is sent out to the liquid transfer hose that is connected to the socket. At this time, gas, such as nitrogen, is taken in from the gas supply hose that is connected to the other socket so that the interior of the container is not a negative pressure state.

A known technology for connecting a socket to a plug in this way by a single operation is a connector (for example, refer to Patent Document 1).

Patent Document 1: Japanese Unexamined Patent Application, Publication No. 2002-114242.

SUMMARY OF THE INVENTION

In the connector disclosed in Patent Document 1 above, the siphon tube extends toward the bottom surface of the container, and an opening of the siphon tube is disposed close to the bottom surface, which allows the amount of liquid that cannot be drawn out from the container (hereinafter referred to as "the amount of remaining liquid") to be reduced.

A container whose bottom surface is curved in a concave shape is also known. As a connector for use in this container, there is also a known technique of curving the siphon tube and disposing a tip of the siphon tube at the deepest region of the bottom surface.

With a combination of this kind of container and connector, the amount of remaining liquid in the container can be further reduced.

However, since the above described connector is configured to be mated with the container, the connector needs to be rotated when it is attached to the container. When rotating the connector, if the siphon tube is curved, it is difficult to dispose the opening of the siphon tube in the deepest region of the container.

When the opening of the siphon tube cannot be disposed in the deepest region described above, it is not possible to reduce the amount of remaining liquid in the container.

The present invention has been conceived to solve the problems described above, and an object thereof is to provide a connector that can reduce the amount of liquid remaining in the container when the liquid stored in the container is drawn out therefrom.

In order to realize the object described above, the present invention provides the following solutions.

The present invention provides a connector that is disposed on a container in which liquid is stored to draw out the liquid, including a connecting unit having a threaded portion that is screwed onto a container-side threaded portion formed at the container; a main body coupled so as to have a common central axis with the connecting unit; and a siphon tube that is secured to the main body and that extends to a bottom portion of the container, wherein the connecting unit and the main body are connected so as to be capable of relatively rotating about the central axis.

According to the present invention, since the connecting unit and the main body are connected so as to be capable of relatively rotating about a central axis C, the connector can be disposed on the container by rotating only the connecting unit. In other words, the connector can be disposed on the container without rotating the siphon tube that is secured to the plug portion provided at the main body.

Therefore, for example, when the connector is disposed on the container, a tip of the siphon tube can be easily disposed in a region where the liquid remains in the container.

In the invention described above, preferably, at least the tip of the siphon tube is curved so as to conform to the bottom surface of the container.

According to the present invention, since at least the tip of the siphon tube is curved so as to conform to the bottom surface of the container, the liquid remaining at the bottom surface can be easily drawn out.

In addition, for example, when at least a portion of the bottom surface of the container is formed in a concave shape, the shape thereof is preferably curved so that the tip of the siphon tube is disposed at the concave portion.

Furthermore, in the invention described above, a notched portion is preferably formed at a tip portion of the siphon tube.

According to the present invention, since the notched portion is formed, even when the inner surface of the container contacts or is adjacent to the tip portion of the siphon tube to block the tip portion thereof, the liquid can flow into the siphon tube from the notched portion. Therefore, the flow rate of the liquid flowing into the siphon tube can be ensured. It is thus possible to draw out the liquid from the container.

With the connector according to the present invention, because the connecting unit and the main body are connected so as to be capable of relatively rotating about the central axis C, the connector can be disposed on the container without rotating the siphon tube that is secured to the plug portion provided at the main body. Therefore, an advantage is provided in that the tip of the siphon tube can be easily disposed in a region of the container where the liquid remains, and thus, the amount of remaining liquid in the container can be reduced.

DETAILED DESCRIPTION OF EMBODIMENT(S) OF THE INVENTION

A connector according to an embodiment of the present invention is described below with reference to FIGS. 1 to 5.

Figure 1:
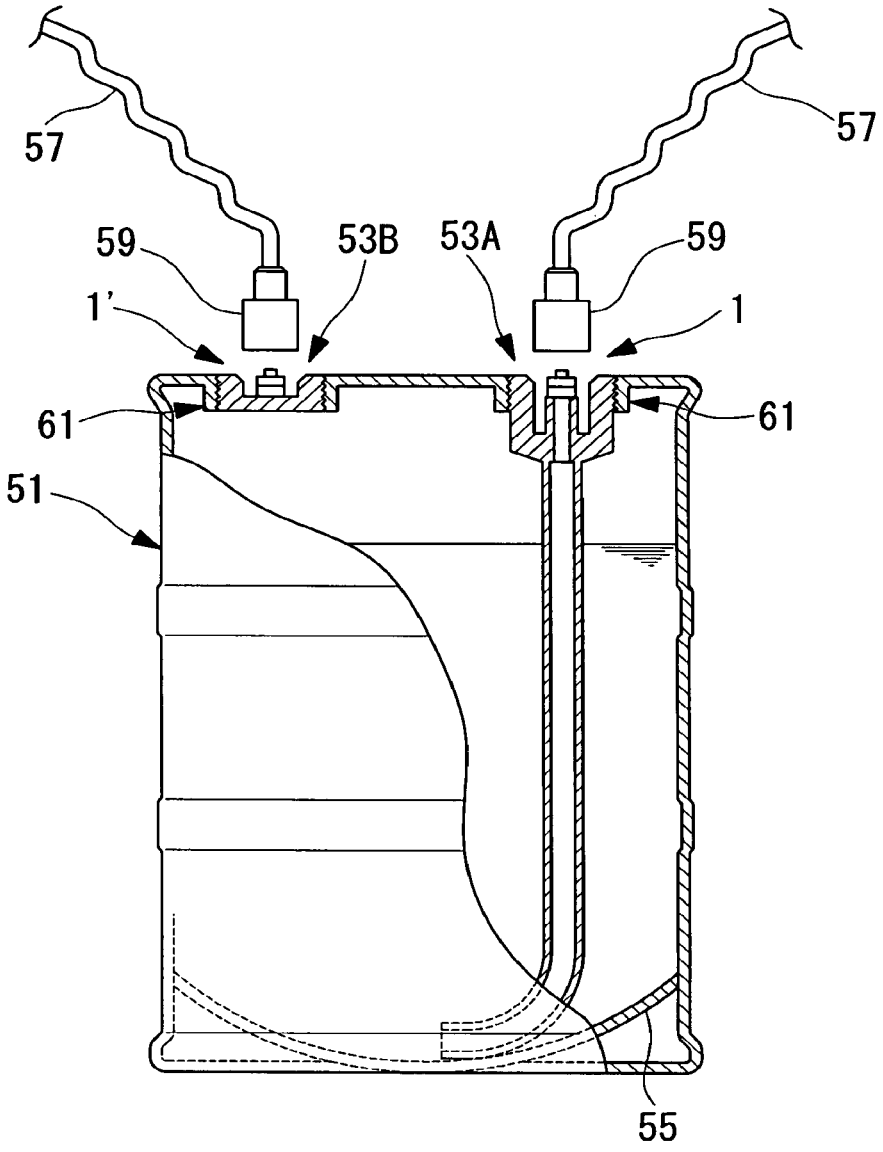
FIG. 1 is a diagram showing a state in which a connector according to the present invention is attached to a container.

FIG. 1 is a diagram showing a state in which a connector according to the present invention is attached to a container.

As shown in FIG. 1, two openings 53A and 53B are formed on the upper surface of a container 51 in which liquid is stored. A connector 1 for drawing out the liquid is disposed at one opening 53A and a connector 1' for supplying gas is disposed at the other opening 53B.

A bottom surface 55 of the container 51 is curved in a concave shape. This figure shows an example of the shape of the bottom surface in which the center part of the container 51 is deepest. It is not limited to this example, however; containers having any other bottom surface shapes may be used.

As shown in FIG. 1, sockets 59 having hoses 57 are removably attached to the connectors 1 and 1'. The liquid inside the container 51 is drawn out through the socket 59 and the hose 57 that are attached to the connector 1. Gas is supplied to the container 51 from the socket 59 and the hose 57 that are attached to the connector 1'.

Figure 2:
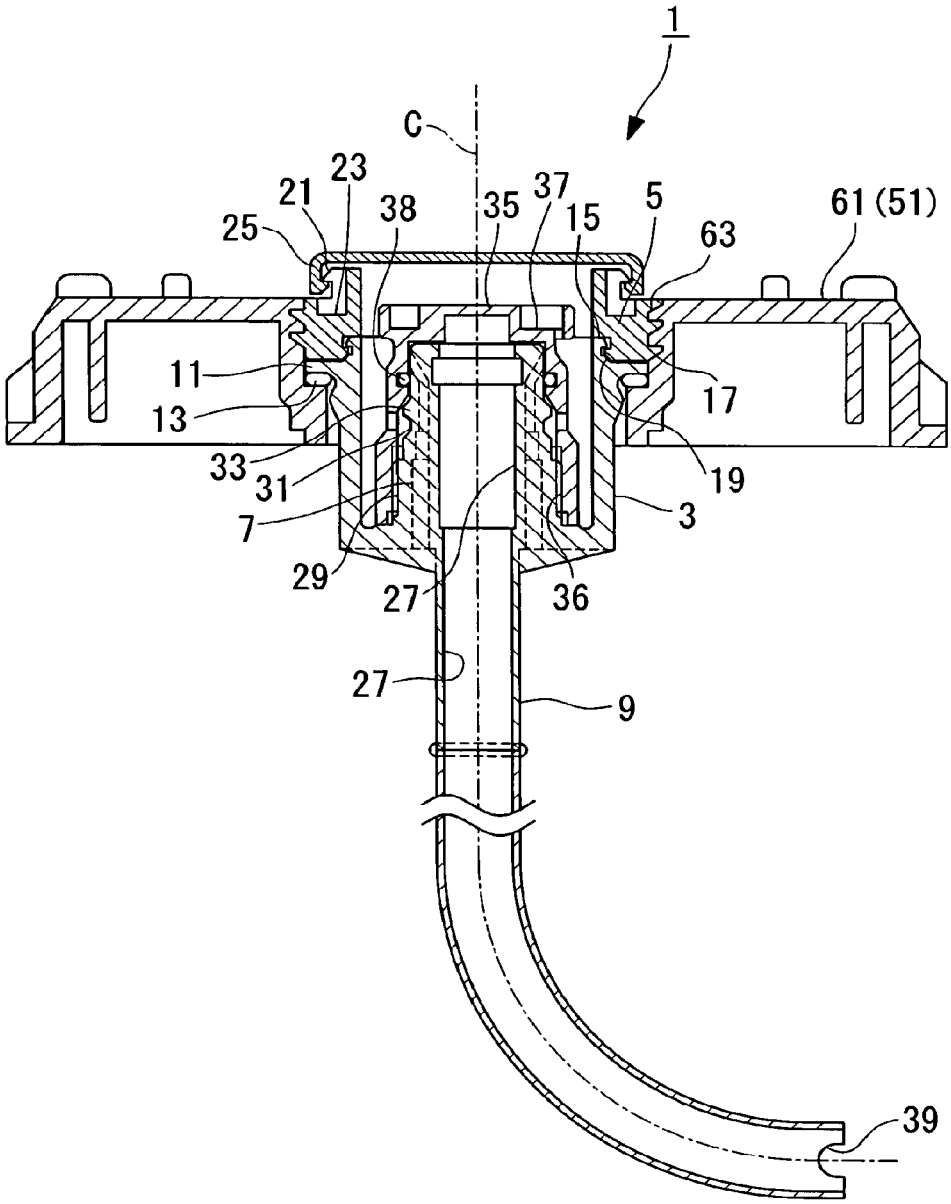
FIG. 2 is a sectional view showing the configuration of the connector in FIG. 1.

Next, the connector 1 will be described. FIG. 2 is a sectional view showing the configuration of the connector in FIG. 1.

As shown in FIGS. 1 and 2, the connector 1 is mainly formed of a connector main body (main body) 3 that forms the main body of the connector 1; a connecting unit 5 that is connected to the container 51 by being screwed onto a female threaded portion 63 formed at an inner lid 61 of the container 51; a plug portion 7 that serves as a coupling portion with the socket 59 described above; and a siphon tube 9 that is secured to the plug portion 7 and that extends to the inside of the container 51.

The connector main body 3 is a substantially cylindrical shape having a bottom surface and the plug portion 7 is integrally formed in the interior thereof. In addition, the substantially cylindrical connecting unit 5 is provided at an opening end of the connector main body 3 so as to be rotatable about a central axis C of the connector main body 3 and the connecting unit 5.

A guard portion 11 protruding outward in the radial direction is formed on the outer circumferential surface of the connector main body 3. An O-ring 13 that serves as a sealing member is disposed on a surface at the siphon tube 9 side of the guard portion 11 (the lower surface in the drawing). A main-body projection 15 that protrudes outward in the radial direction around the circumferential direction and that engages with the connecting unit 5 is formed at the opening end on the outer circumferential surface of the connector main body 3.

Figure 3:
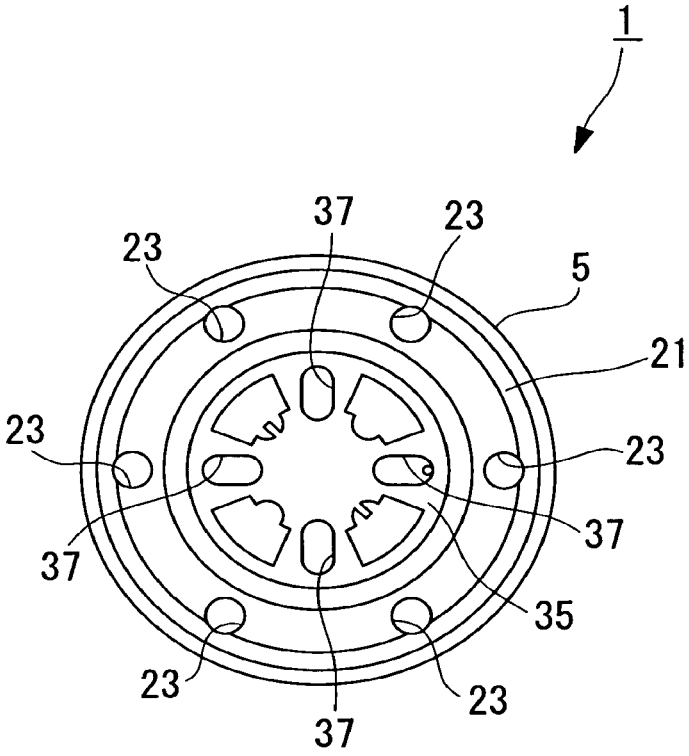
FIG. 3 is a plan view showing a connecting unit of the connector in FIG. 2.

FIG. 3 is a plan view showing a connecting unit 5 of the connector 1 in FIG. 2.

A male threaded portion (threaded portion) 17 that is screwed onto the female threaded portion 63 of the inner lid 61 is formed on the outer circumferential surface of the connecting unit 5. A connecting-unit projection 19 that protrudes inward in the radial direction around the circumferential direction and that engages with the main-body projection 15 of the connector main body 3 is formed at the lower end of the inner circumferential surface of the connecting unit 5. A lid-locking projection 21 that protrudes outward in the radial direction around the circumferential direction and that engages with a sealing lid, described below, is formed at the upper end on the outer circumferential surface of the connecting unit 5. As shown in FIGS. 2 and 3, on the upper surface of the connecting unit 5, connecting holes 23 that engage with a rotating jig, described below, are formed at regular intervals around the same circumference.

The inner diameter of the connecting-unit projection 19 is formed smaller than the outer diameter of the main-body projection 15. The connecting-unit projection 19 is engaged with the main-body projection portion 15 by press-fitting the connecting unit 5 into the connector main body 3. The connecting unit 5 and the connector main body 3 are thus engaged with each other in such a manner as to allow rotation about the central axis C.

As shown in FIG. 2, the sealing lid 25 is attached to the connector 1 by the lid-locking projection 21 described above and prevents dust from entering from outside. When the socket 59 is to be attached to the connector 1, the sealing lid 25 is removed from the connector 1. The sealing lid 25 is formed so as to be removed by breaking it or by subjecting it to a plastic deformation, when the sealing lid 25 is removed from the connector 1. Thus, by checking for the presence of the sealing lid 25, it can be determined whether or not the container 51 has already been used.

As shown in FIG. 2, the plug portion 7 is substantially cylindrical and integrally formed with the bottom surface of the connector main body 3 (the lower surface in the drawing). The inside of the plug portion 7 is a flow hole 27 through which the liquid flows. In addition, a cap threaded portion 29 for mating with a cap, described later, is formed on the lower end of the outer circumferential surface of the plug portion 7 (the lower side in the drawing). A ring-shaped locking groove 31 and locking projection 33 that engage with the socket 59 are formed at the middle of the outer circumferential surface.

As shown in FIG. 2, the cap 35 is formed in a substantially cylindrical shape having a bottom surface. A threaded portion 36 that is screwed onto the cap threaded portion 29 described above is formed at an opening end on the inner circumferential surface of the cap 35. An O-ring 38 that contacts with the outer circumferential surface of the plug portion 7 to prevent the liquid from leaking is disposed on the upper part of the inner circumferential surface of the cap 35. In addition, as shown in FIGS. 2 and 3, on the upper end surface of the cap 35 (the top end surface in the drawing), cap holes 37 that engage with a jig (not shown) for rotating the cap 35 are formed at regular intervals around the same circumference.

The cap 35 is removed from the plug portion 7 when the socket 59 is to be attached to the connector 1, and in cases other than this, the cap 35 is attached to the plug portion 7 to prevent the liquid from leaking out.

When the cap 35 is to be removed, the cap 35 is removed by attaching the above described jig to the cap hole 37 and rotating the cap 35.

As shown in FIG. 2, the siphon tube 9 is curved so that the tip of the opening portion thereof is oriented substantially in the lateral direction and has a semicircular notched portion 39 at its opening. In addition, the siphon tube 9 is integrally formed with the above described connector main body 3 and the plug portion 7; the flow hole 27 in which the liquid in the siphon tube 9 flows and the flow hole 27 of the plug portion 7 communicate with each other.

Next, the operation of attaching the connector 1, having such a configuration, to the container 51 will be described.

First, as shown in FIG. 1, the connector 1 is inserted into the opening 53A of the container 51 (inner lid 61) from the siphon tube 9 side. At this time, the connector main body 3 and the connecting unit 5 are rotatable about the central axis C, and the sealing lid 25 is not attached to the connector 1. Once the connector 1 is inserted into the opening 53A, the tip of the siphon tube 9 is disposed in the deepest region of the bottom surface 55 by rotating the connector main body 3.

Figure 4:
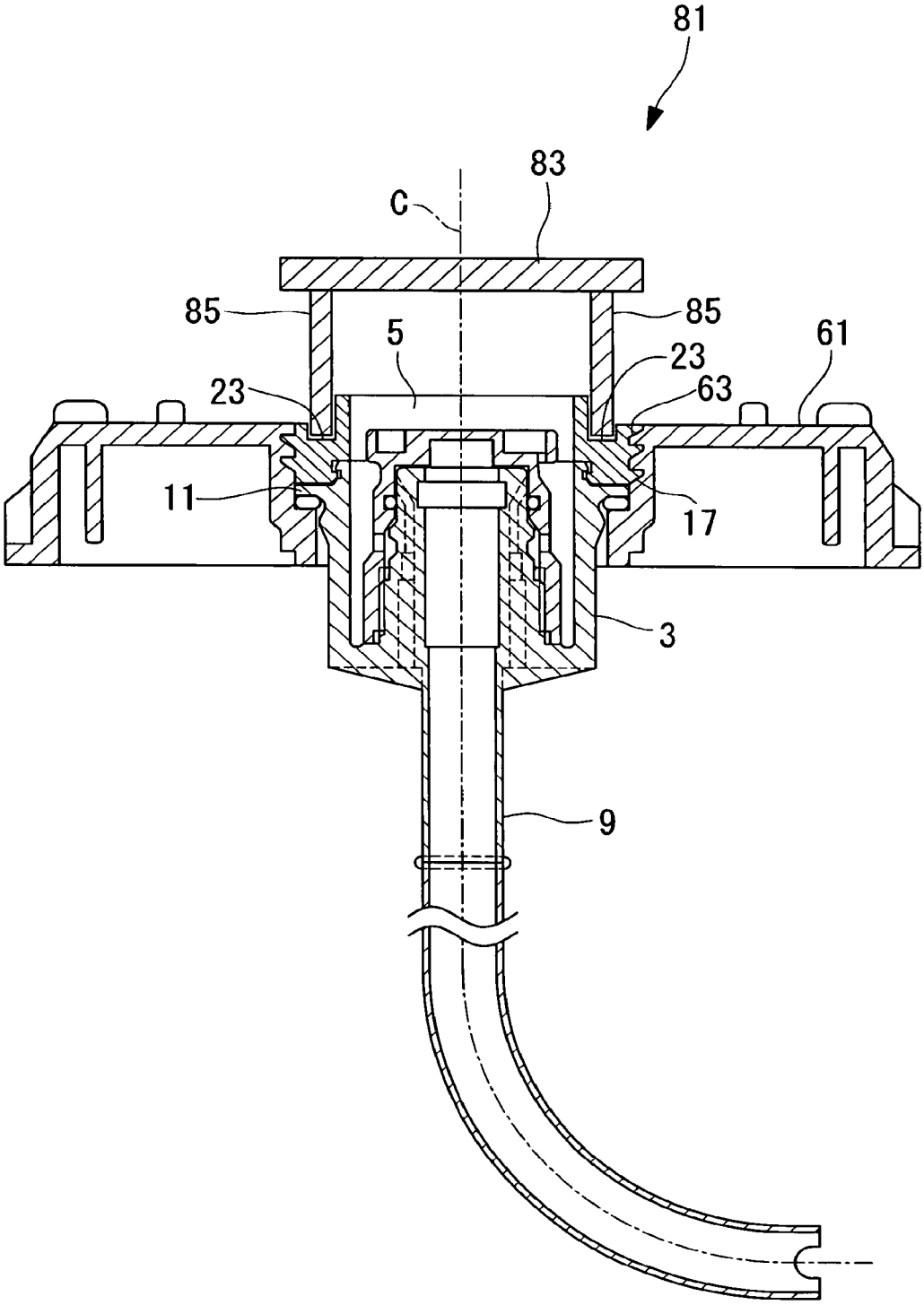
FIG. 4 is a diagram showing a method of attaching a rotating jig to the connector.

FIG. 4 is a diagram showing a method of attaching a rotating jig 81 to the connector 1.

As shown in FIG. 4, the rotating jig 81 is attached to the connecting hole 23 of the connecting unit 5. The rotating jig 81 is formed of a circular plate-shaped base 83 and a connecting rod 85 extending substantially perpendicularly from the base 83 and is attached by inserting the connecting rod 85 into the connecting hole 23.

After the rotating jig 81 is attached, by rotating the connecting unit 5 using the rotating jig 81 while holding the connector main body 3 and the siphon tube 9 so as not to rotate relative to the inner lid 61, the female threaded portion (container-side threaded portion) 63 and the male threaded portion 17 are screwed together. At this time, a tightening torque applied to the connecting unit 5 is preferably controlled to be a predetermined value. For example, the tightening torque may be controlled by tightening the rotating jig 81 and the connecting unit 5 using a torque wrench.

By tightening the connecting unit 5, the guard portion 11 of the connector main body 3 is pinched by the connecting unit 5 and the inner lid 61, causing the rotation about the central axis C of the connector main body 3 or the siphon tube 9 to be restricted.

Thereafter, as shown in FIG. 2, the sealing lid 25 is attached to the connector 1, which completes the attachment of the connector 1.

According to the configuration described above, since the connector main body 3 and the connecting unit 5 are connected so as to be capable of relatively rotating about the central axis C, the connector 1 can be disposed on the container 51 without rotating the plug portion 7 or the siphon tube 9 that are integrally formed with the connector main body 3. Therefore, when the connector 1 is disposed on the container 51, the tip of the siphon tube 9 can be easily disposed in the region where the liquid remains in the container 51. Accordingly, the amount of remaining liquid can be reduced.

Because at least the tip of the siphon tube 9 is curved so as to conform to the bottom surface 55 of the container 51 and the tip thereof is disposed in the deepest region of the bottom surface 55, the liquid remaining at the bottom surface 55 can be easily drawn out. Accordingly, the amount of remaining liquid can be reduced.

In addition, since the notched portion 39 is formed at the tip of the siphon tube 9, even when the inner surface of the container 51 contacts or is adjacent to the tip portion of the siphon tube 9 so as to block the tip portion thereof, the liquid can flow into the siphon tube 9 from the notched portion 39. Therefore, the flow rate of the liquid flowing into the siphon tube 9 can be ensured. It is thus possible to draw out the liquid from the container.

Figure 5:
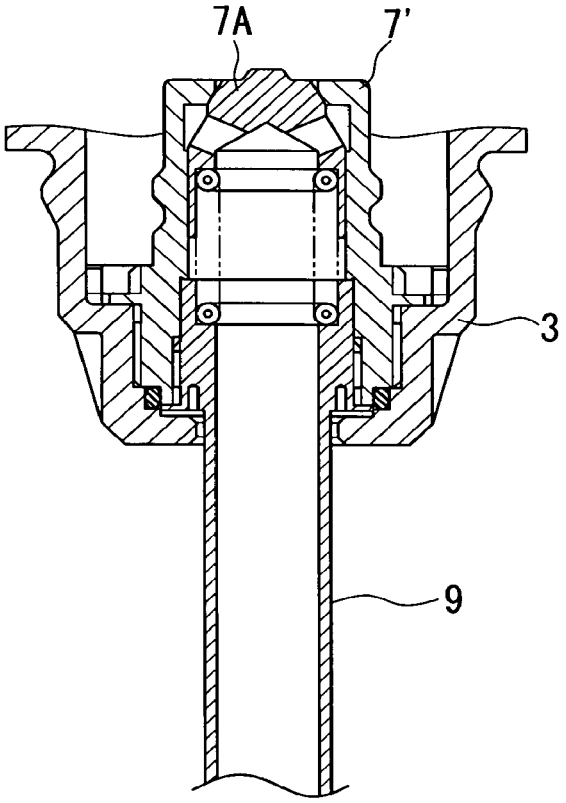
FIG. 5 is a sectional view showing another embodiment of a connector according to the present invention.

As described above, the connector main body 3, the plug portion 7, and the siphon tube 9 may be integrally formed, or as shown in FIG. 5, the connector main body 3, the plug portion 7', and the siphon tube 9 may be independently formed. The plug portion 7 and the siphon tube 9 may also be secured to the connector main body 3.

The structure is not particularly limited, however; the plug portion 7 without a valve in the interior thereof, as described above, may be used, or as shown in FIG. 5, the plug portion 7' having a valve 7A in the interior thereof may be used.

The invention claimed is:

1. A connector that is disposed on a container in which liquid is stored to draw out the liquid, comprising:

a connecting unit having a threaded portion that is screwed onto a container-side threaded portion formed at the container;

a main body coupled so as to have a common central axis with the connecting unit; and a siphon tube that is secured to the main body and that extends to a bottom surface of the container, wherein the connecting unit and the main body are connected so as to be capable of relatively rotating about the central axis, such that a connecting-unit projection of the connecting unit engages with a main-body projection of the main body, the main body comprises a guard portion that protrudes radially outward from an outer circumferential surface thereof, the container side threaded portion comprises a step portion that protrudes radially inwardly from an inner circumferential surface thereof, toward the main body, a sealing member is disposed between a surface of the guard portion and a surface of the step portion that face each other, the connecting unit comprises the connecting-unit projection that extends radially inward from an inner surface toward the central axis, the main body comprises the main-body projection that extends outwardly from an outer surface away from the central axis, the main body comprises a cylindrical outer portion connected to a cylindrical, inner plug portion at a bottom thereof, and the siphon tube connects to and extends from the bottom of the main body, an inner diameter of the connecting-unit projection is smaller than an outer diameter of the main-body projection and the main-body projection is received in a groove defined in the connecting unit above the connecting-unit projection, the inner diameter of the connecting-unit projection is smaller than an inner diameter of the step portion, and at least a tip portion of the siphon tube is curved to conform to the bottom surface of the container and to be disposed in the deepest region of the bottom surface.

2. The connector of claim 1, wherein a notched portion is formed at the tip portion of the siphon tube.

3. The connector of claim 1, wherein the connecting unit comprises a plurality of engaging holes on an upper surface, the engaging holes are disposed at regular intervals around a circumference of the upper surface, and the engaging holes are engageable with a rotating jig.

4. The connector of claim 1, further comprising a cap positionable around and above the plug portion and engageable with the plug portion.

5. The connector of claim 4, wherein the cap threadedly engages the plug portion.

6. The connector of claim 5, wherein the cap comprises a plurality of cap holes that are engageable with a jig, permitting the cap to be threaded disengaged from the plug portion.

7. The connector of claim 4, further comprising a seal disposed between an outer surface of the plug portion and an inner surface of the cap to prevent leakage of liquid thereby when the cap engages the plug portion.

8. The connector of claim 1, wherein the main body and the siphon tube are integrally formed.

9. The connector of claim 1, wherein the main body, the plug portion, and the siphon tube are integrally formed.

10. The connector of claim 1, wherein the main body, the plug portion, and the siphon tube are independent structures that are connected to one another.

11. The connector of claim 10, further comprising:

a valve disposed interior to the plug portion.

12. The connector of claim 1, further comprising a sealing lid engageable with the connecting unit.

13. The connector of claim 1, wherein the connecting unit abuts against the guard portion.

14. The connector of claim 13, wherein a bottom surface of the connecting unit and the surface of the step portion pinch the guard portion and the sealing member therebetween.

15. The connector of claim 14, wherein an inner diameter of the connecting-unit projection is smaller than an outer diameter of the main-body projection and the main-body projection is received in a groove defined in the connecting-unit above the connecting-unit projection, above the guard portion, and above the step portion.

16. The connector of claim 1, further comprising a lid-locking projection protruding radially outward from an outer surface of the connecting unit away from the central axis.

* * * * *